US009796462B2

(12) United States Patent
Conesa Gracia

(10) Patent No.: US 9,796,462 B2
(45) Date of Patent: Oct. 24, 2017

(54) ASSEMBLY FOR RETRACTABLE THRUSTER

(71) Applicant: Rolls-Royce Marine AS, Ulsteinvik (NO)

(72) Inventor: Xavier Conesa Gracia, Hareid (NO)

(73) Assignee: Rolls-Royce Marine AS, Ulsteinvik (NO)

( * ) Notice: Subject to any disclaimer, the term of this patent is extended or adjusted under 35 U.S.C. 154(b) by 334 days.

(21) Appl. No.: 14/719,633

(22) Filed: May 22, 2015

(65) Prior Publication Data

US 2015/0336648 A1 Nov. 26, 2015

(30) Foreign Application Priority Data

May 22, 2014 (NO) ..... 20140643

(51) Int. Cl.

| | |
|---|---|
| ***B63H 5/125*** | (2006.01) |
| ***B63H 21/12*** | (2006.01) |
| ***B63H 21/36*** | (2006.01) |
| *B63H 25/42* | (2006.01) |

(52) U.S. Cl.

CPC ..... *B63H 5/125* (2013.01); *B63H 21/12* (2013.01); *B63H 21/36* (2013.01); *B63H 2005/1254* (2013.01); *B63H 2025/425* (2013.01)

(58) Field of Classification Search

CPC ..... B63H 5/125; B63H 5/1252; B63H 21/12; B63H 21/36; B63H 25/42; B63B 17/00; B63B 17/0018

USPC ..... 440/53, 54, 58, 112

See application file for complete search history.

(56) References Cited

U.S. PATENT DOCUMENTS

| | | | | |
|---|---|---|---|---|
| 2,156,938 | A * | 5/1939 | Edwards | B63H 5/125 440/54 |
| 2,302,795 | A * | 11/1942 | Noble | B63H 25/42 440/54 |
| 2,987,027 | A * | 6/1961 | Wanzer | B63H 25/42 440/54 |
| 3,807,347 | A * | 4/1974 | Baldwin | B63H 5/20 440/54 |
| 4,573,929 | A * | 3/1986 | Savikurki | B63H 5/125 440/54 |
| 6,458,004 | B2 * | 10/2002 | Van Breems | B63H 5/1252 440/54 |
| 7,641,526 | B1 * | 1/2010 | Bekker | B63H 5/125 440/54 |
| 9,623,942 | B2 * | 4/2017 | Schiaffino | B63H 5/125 |

* cited by examiner

*Primary Examiner* — Lars A Olson

(74) *Attorney, Agent, or Firm* — Alix, Yale & Ristas, LLP

(57) ABSTRACT

An assembly for a retractable thruster suitable for attachment to the hull of a maritime vessel. The assembly comprises a thruster accommodating structure from which the thruster may be deployed into and retracted from the water. The thruster accommodating structure is provided with a drive assembly that suspends the thruster and further comprises a thruster deploying and retracting device, a thruster rotating device, a motor assembly, and a switching device. The same drive assembly is used for deploying, retracting, and rotating the thruster.

21 Claims, 11 Drawing Sheets

ASSEMBLY FOR RETRACTABLE THRUSTER

BACKGROUND

The disclosure is related to an assembly for a retractable thruster for attachment to a maritime vessel.

Examples of retractable thrusters for vessels may be found in the following issued patents and printed publications. U.S. Pat. No. 3,807,347 A by Baldwin discloses an assembly, particularly an auxiliary power source, for sailboats. A propeller is connected to a shaft extending through an aperture in the hull to a drive unit which supplies propulsion power to the propeller. The propeller is lowered into the water and retracted into the hull, respectively, via a flexible cable actuated manually from the top of the sailboat.

EP 2 210 809 A2 by Klingenburg GMBH discloses a thruster that is movable upwards and downwards in an out of the thruster housing, by means of a threaded rod rotated by an external drive means. The thruster itself is arranged rotary about a vertical axis to enable the vessel to be moved in the desired direction by the thruster.

NL 1 020 217 C1 by Wouter Steusel discloses an electrically driven propeller device especially developed for sailboats. A housing accommodates a control drum arranged rotary and vertically displaceable therein. A propeller system is arranged at the lower end of the housing and driven by a first drive means to advance the vessel in the water. A second drive means is arranged at the top to enable rotation of the propeller system about its vertical axis to move the vessel in the desired direction.

EP 2 657 127 A1 (Beacon Finland LTD OY) relates to a retractable thruster comprising a rack and pinion drive to enable vertical movement of the thruster and allow service operations to be performed on the propeller driver also when the thruster is retracted.

CN 202054138 U (NANTONG ZHENHUA HEAVY EQUIPMENT MFG CO LOTD) discloses a retractable propeller driven by a permanent magnet motor and further comprises guiding rods, traverse rods, and several motors.

EP1959163 discloses a combined linear and rotary actuator for a retractable thruster having a shaft with a screw thread, a nut engaging the screw thread, and engaging means movable between a first location where rotation of the turning mechanism produces substantially linear displacement of the shaft, and a second location where rotation of the turning mechanism produces substantially rotary displacement of the shaft.

WO2009014296 discloses an icebreaking additional propulsion system including at least one retractable thruster capable of vertically moving into and out of the hull of a ship. The retractable thruster includes a pair of guide rods vertically installed within the hull, a column vertically movable along the guide rods, a drive unit mounted to an upper end of the column for vertically moving and swiveling the column, and a propeller attached to a lower end of the column for generating propelling power.

U.S. Pat. No. 5,522,335 discloses an auxiliary thruster for a marine vessel including a submersible propulsion unit which has a shroud with a propeller rotatably mounted therein. Further, it describes a propulsion unit deploying and rotating mechanism mounted on the hull and on the propulsion unit operable to extend the propulsion unit out of the hull and retract it into the hull and to rotate the propulsion unit to direct the thrust generated thereby in any desired direction when the thruster is in the deployed position. When the thruster is retracted, it is positioned with a tunnel extending transversely through the hull. Rotation of the propeller while in the retracted position generates laterally directed thrust through the tunnel.

WO2011031158 discloses a retractable thruster assembly comprising: a thruster head with a propeller, a casing structure vertically guided in the thruster well, the casing structure having a lower end portion to which the thruster head is mounted so as to extend below the casing structure, the casing structure including a watertight compartment, and an electric propeller drive motor being housed in said compartment. The thruster assembly is vertically displaceable between an operative extended position, in which the thruster head projects downward beyond the bottom plane of the hull, and a retracted position, in which the thruster assembly is raised and the thruster head is received with the thruster well.

SUMMARY

The disclosure provides an assembly for a retractable thruster that reduces the number of drive means. The disclosure also provides an assembly for a retractable thruster that reduces the number of movable mechanical parts that are subject to wear and breakdown. The disclosure provides an assembly for a retractable thruster with a reduced space requirement that enables steering once the thruster is deployed.

The disclosed embodiment is related to an assembly for a retractable thruster which is suitable for attachment to a hull of a maritime vessel. The assembly comprises a thruster accommodating structure, from which the thruster may be deployed into the water, and retracted into from the water. In accordance with the disclosure, the thruster accommodating structure minimizes the volume requirement, is substantially cylindrically shaped, and is provided with a drive assembly to which a thruster is suspended. However, a cylindrical shape is not required. The drive assembly further comprises a thruster deploying and retracting device, a thruster rotating device, a motor assembly, and a switching device that allows power to be transferred either to the thruster deploying and retracting device, to enable movement of the thruster along a longitudinal axis of the thruster accommodating structure, or allows power to be transferred to the thruster to enable rotation of the thruster about the longitudinal axis of the thruster accommodating structure to a desired direction and hence allow steering and propulsion of the vessel.

The thruster accommodating structure may be provided in the form of a barrel-like, e.g. cylindrically shaped, container provided with internal threads or rollers in a movable engagement with the upper housing of the drive assembly and provided with guiding means extending along the longitudinal axis of the container in a sliding engagement with lugs or similar attached to a non-rotary part of the drive assembly. The container may optionally be provided with apertures with a dimension similar to the thruster nozzle to allow the thruster to be operated in a retracted position. This embodiment does naturally require a similar aperture to be formed in the hull.

In another embodiment, the thruster accommodating structure may be provided in the form of a frame structure without continuous walls. Also this embodiment is provided with similar guiding means and rollers or sliders in engagement with corresponding components of the drive assembly. The latter embodiment requires less material and allows the customer to decide whether the assembly with its thruster is going to be used both in a retracted position and in a lowered position.

The verb "lower" is intended to define movement in a direction out of the structure that accommodates the thruster in a retracted position. Therefore, the term "lower" refers to a direction when the assembly is arranged upright in the hull where the thruster is moved substantially vertically in the structure.

Accordingly, the terms "upper" and "lower" used hereinafter in the present specification should be interpreted accordingly and are used solely of illustrative purpose to simplify interpretation of the present disclosure.

As mentioned above, the drive assembly comprises an upper housing which is arranged rotary in relation to the container or frame structure, and a lower housing arranged vertically movable within said container or frame structure but fixed against rotation with the same. The lower housing accommodates a motor assembly including a switching device that directs the power from the motor assembly either to the upper housing or to a thruster suspended under the lower housing.

It can also be considered an option in which the thruster always is rotating, whereas the retractable mechanism is not, which will be engaged when the switch is activated.

The motor assembly may be provided, e.g., in the form of a permanent magnet motor or an electrical motor without permanent magnets. However, alternative devices are also conceivable, such as hydraulic drive mechanism. Generally, a permanent magnet motor is preferred because hydraulic systems are subject to leakage and require more servicing. Moreover, hydraulic systems need time (approximately 10 minutes) to warm up the oil to the required operating temperature.

In the following, the drive means is described in the form of a permanent magnet motor, but this is not intended to limit the scope of protection as indicated above.

The assembly in accordance with the present disclosure possesses several advantages over prior art assemblies for retractable thrusters. If the drive means is provided as permanent magnet motor, there are no hydraulic conduits or chambers. Hence, there is no warm-up time and the thruster may be operated instantaneously. Nevertheless, the double-functioning drive means arranged within the assembly provides a highly compact assembly compared to similar prior art assemblies. Typically, a volume reduction of from 20% to 50% may be achieved compared to the prior art. Accordingly, the assembly can be installed far forward in the vessel where the hull shape is narrow, a location which heretofore has been impossible. Nevertheless, the reduced size of the assembly requires accordingly less space when mounted inside the vessel itself. Moreover, the assembly may be provided in the form of a plug and play assembly with a lean and predefined interface between assembly and vessel utilities that shortens the commissioning time.

BRIEF DESCRIPTION OF THE DRAWINGS

The disclosure will be described in further detail in the form of non-limiting embodiments with reference to drawings, where:

FIG. 10*a* illustrates a situation where power is transferred to the thruster deploying and retracting device, whereas FIG. 10*b* illustrates a situation where power is transferred to the thruster to enable rotation of the latter.

DETAILED DESCRIPTION

Figure 1A:
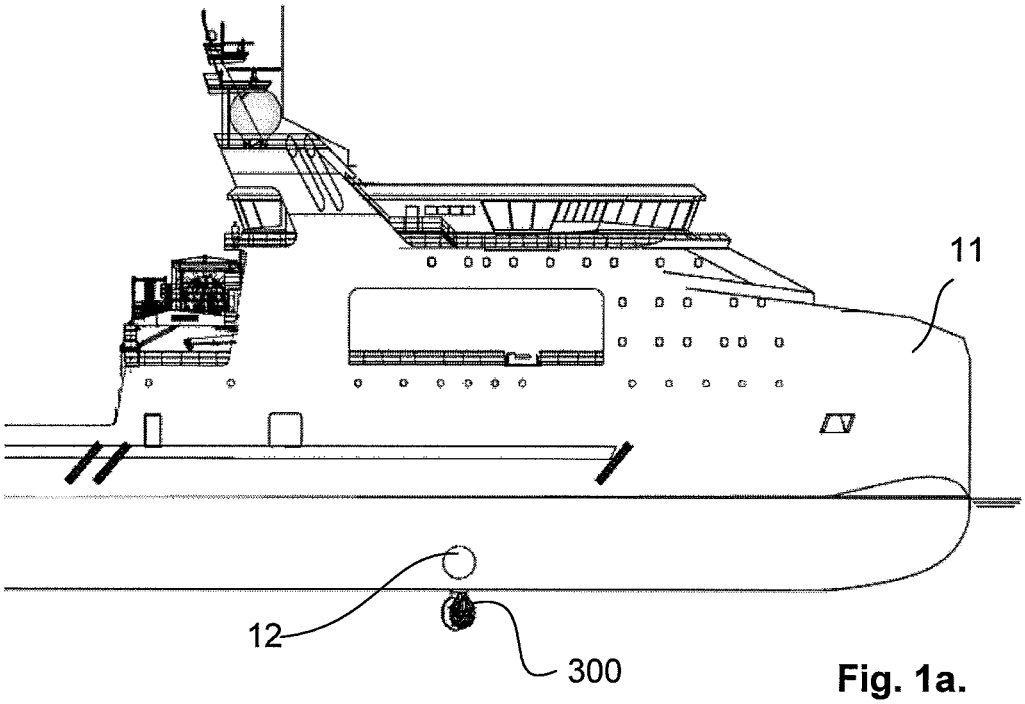
FIGS. 1*a* and 1*b* illustrate the position of a thruster assembly in accordance with the thruster assembly mounted to a vessel.
Figure 1B:
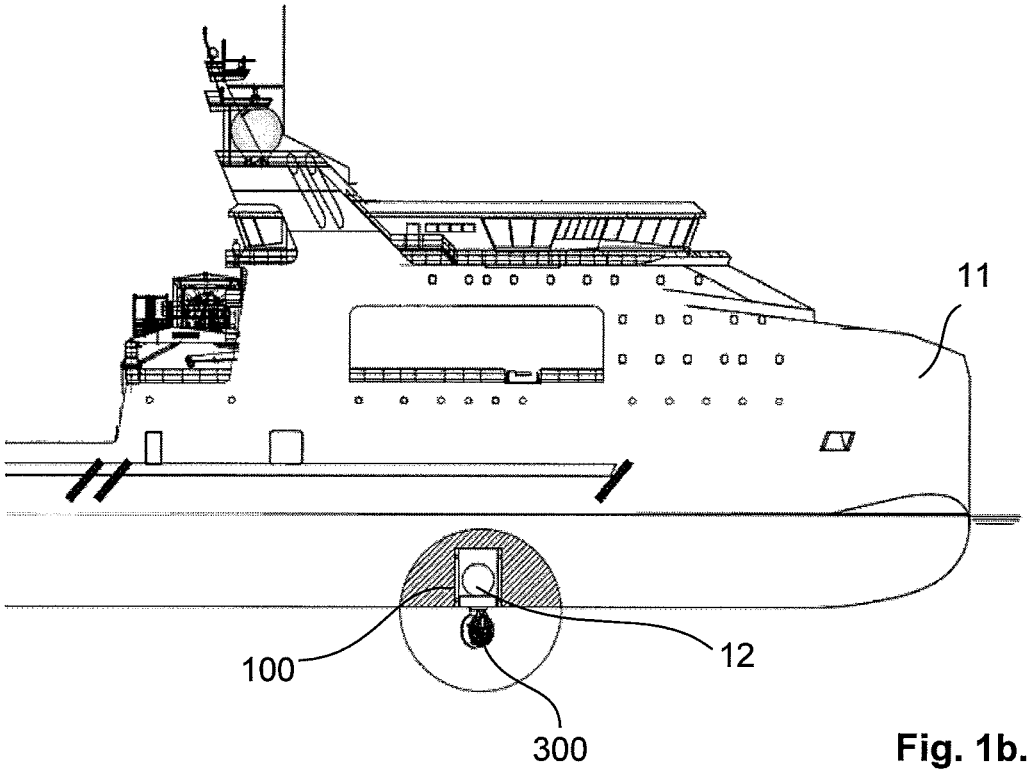

FIGS. 1*a* and 1*b* illustrates an example of a thruster assembly in accordance with the disclosure mounted in a marine vessel 11. FIG. 1*b* illustrates a partial cross section through the hull of the vessel 11. In this embodiment, a through circular aperture 12 has been arranged both in the hull and in a thruster accommodating structure 100 of the thruster assembly mounted in the hull. The thruster accommodating structure 100 is arranged to accommodate the thruster 300 when in a retracted position. Both drawings illustrate the thruster 300 in a condition ready to operate.

Figure 2:
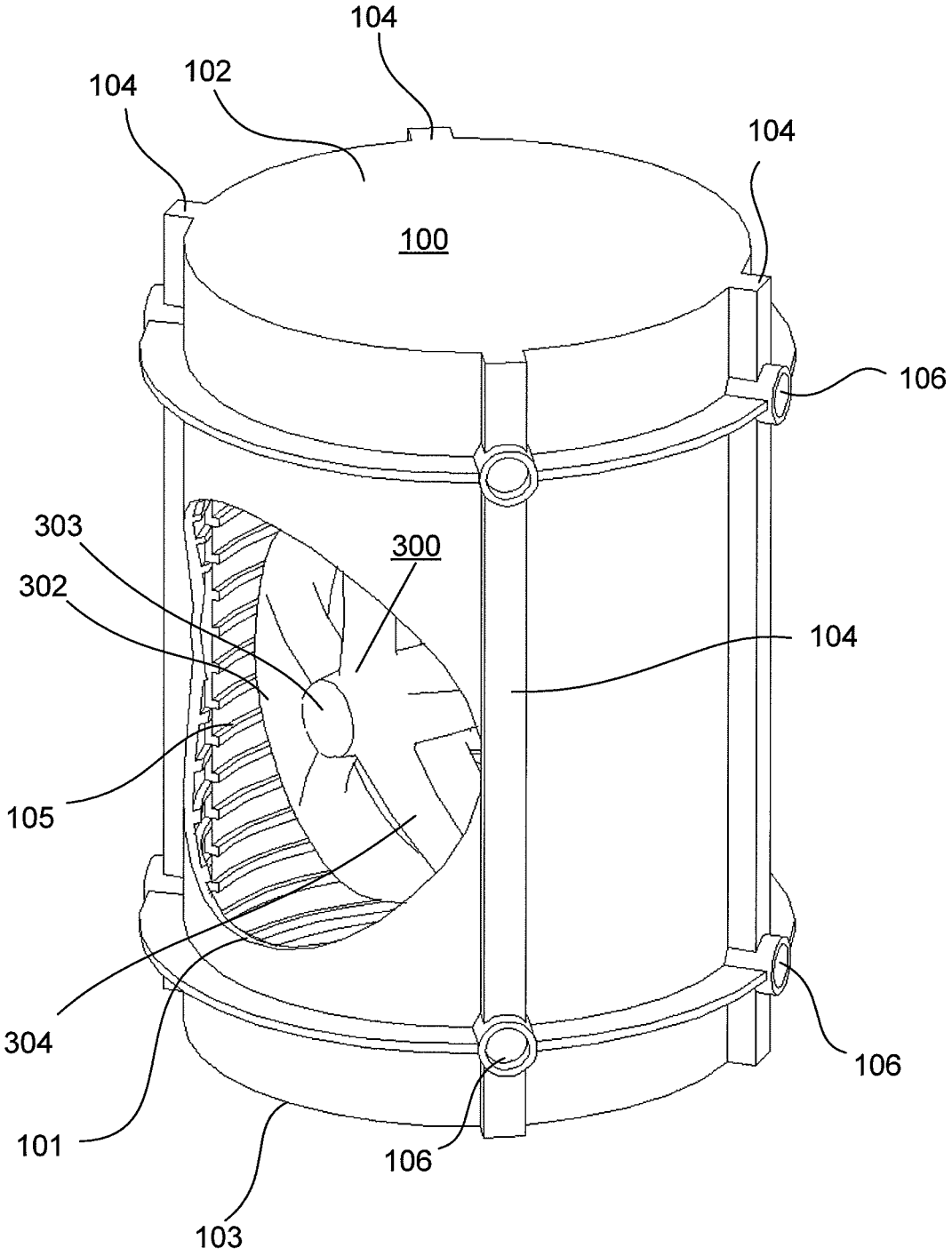
FIG. 2 is a perspective drawing that illustrates the thruster assembly of FIG. 1 in a retracted position.

FIG. 2 depicts a perspective view of the thruster assembly. The main components of the thruster assembly are, in a first embodiment, comprised by a thruster accommodating structure provided in the form of a barrel-like cylinder shaped container 100, a drive assembly (not depicted in this figure) and a thruster indicated generally at 300 and comprising a nozzle 302, a propeller drive shaft 303, and propellers 304. The container 100 exhibits a closed upper end 102 and an open lower end 103. The size of the container 100 is sufficient to accommodate the drive assembly and the thruster, when the latter is being located in a retracted position inside the container 100, as illustrated in FIG. 2. Moreover, the internal wall of the container is provided with threads 105 involved in lowering and retracting of the thruster 300 within the container 100. This is described in further detail below. Elongate vertically extending guiding means 104 are provided in the container wall to accommodate lugs on a drive assembly as described below. During lowering and retracting of the drive assembly and thruster, the lugs slide within the guiding means to prevent the thruster and drive assembly from rotating. Numerous apertures 106 are provided in the container wall to accommodate fastening means, such as bolts, to attach the thruster assembly to the hull. Moreover, the illustrated embodiment exhibits two opposing apertures 101 in the container wall having a size and geometry substantially corresponding to the nozzle 302 of the thruster 300. This arrangement allows the thruster 300 to be operated also in a retracted position within the container 100 and within the hull of a vessel 11. However, the apertures 101 are optional and are not required to obtain the advantages set forth above.

Figure 3:
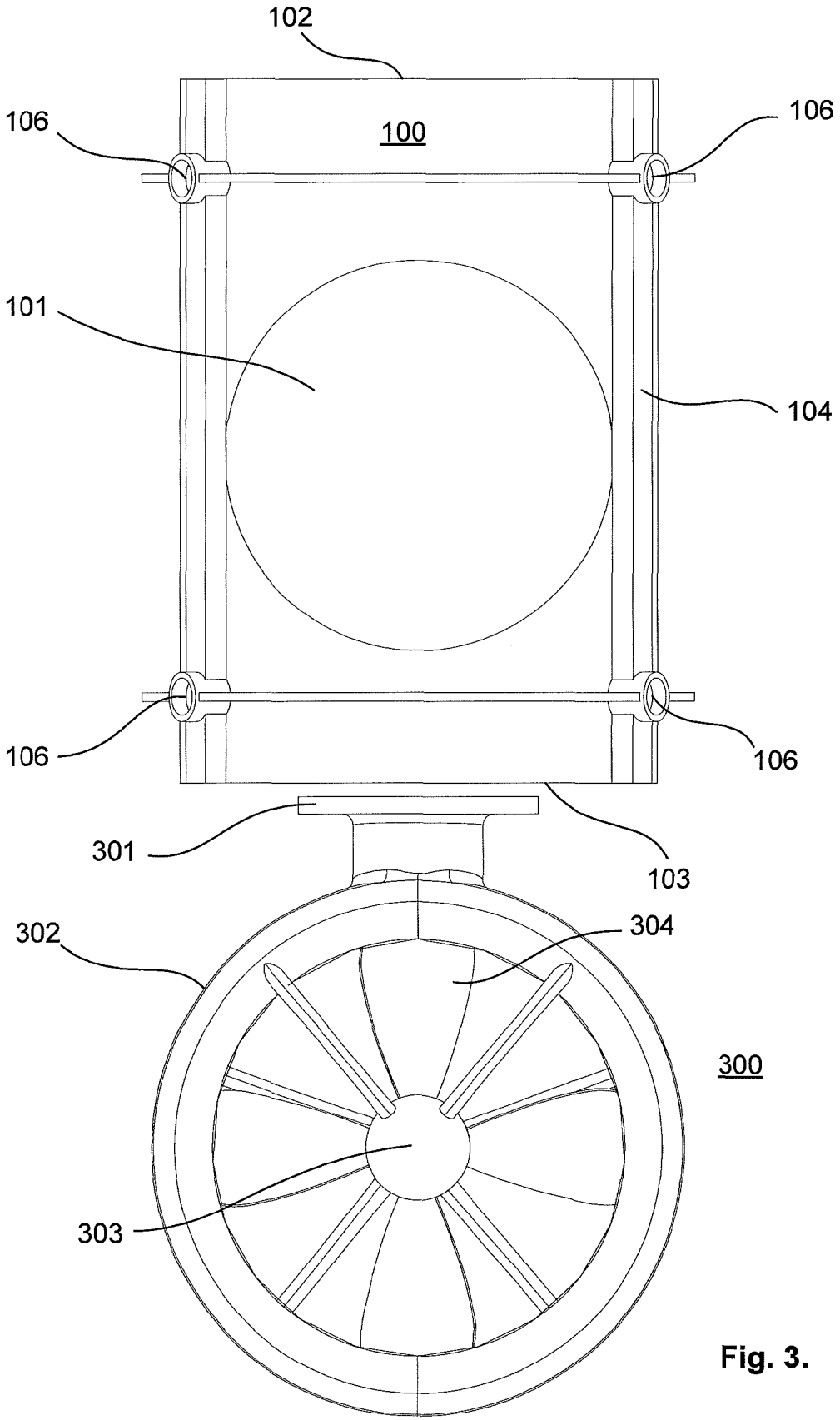
FIG. 3 is a side view of the thruster assembly of FIG. 1 in a (fully) lowered position.

FIG. 3 is a side view, similar to FIG. 2, where the thruster 300 is located in a lowered position suspended under the container 100 by a flange 301 connected to the drive assembly to be described in further detail below. Any type of propulsion means suspended under the drive assembly in the thruster assembly may be used in this context. Accordingly, the details of the thruster itself have been omitted from this specification because it is considered to be within the scope of a person skilled in the art. In this position, the thruster 300 is arranged in an operational position and may be rotated by the drive assembly described below about the longitudinal axis of the container 100 to rotate the thruster 300 in the desired direction to control and propulsion the vessel 11. However, it is also conceivable to provide the thruster 300 with a tilting device (not shown) to enable further orientation of the thruster 300 in the water.

Figure 4:
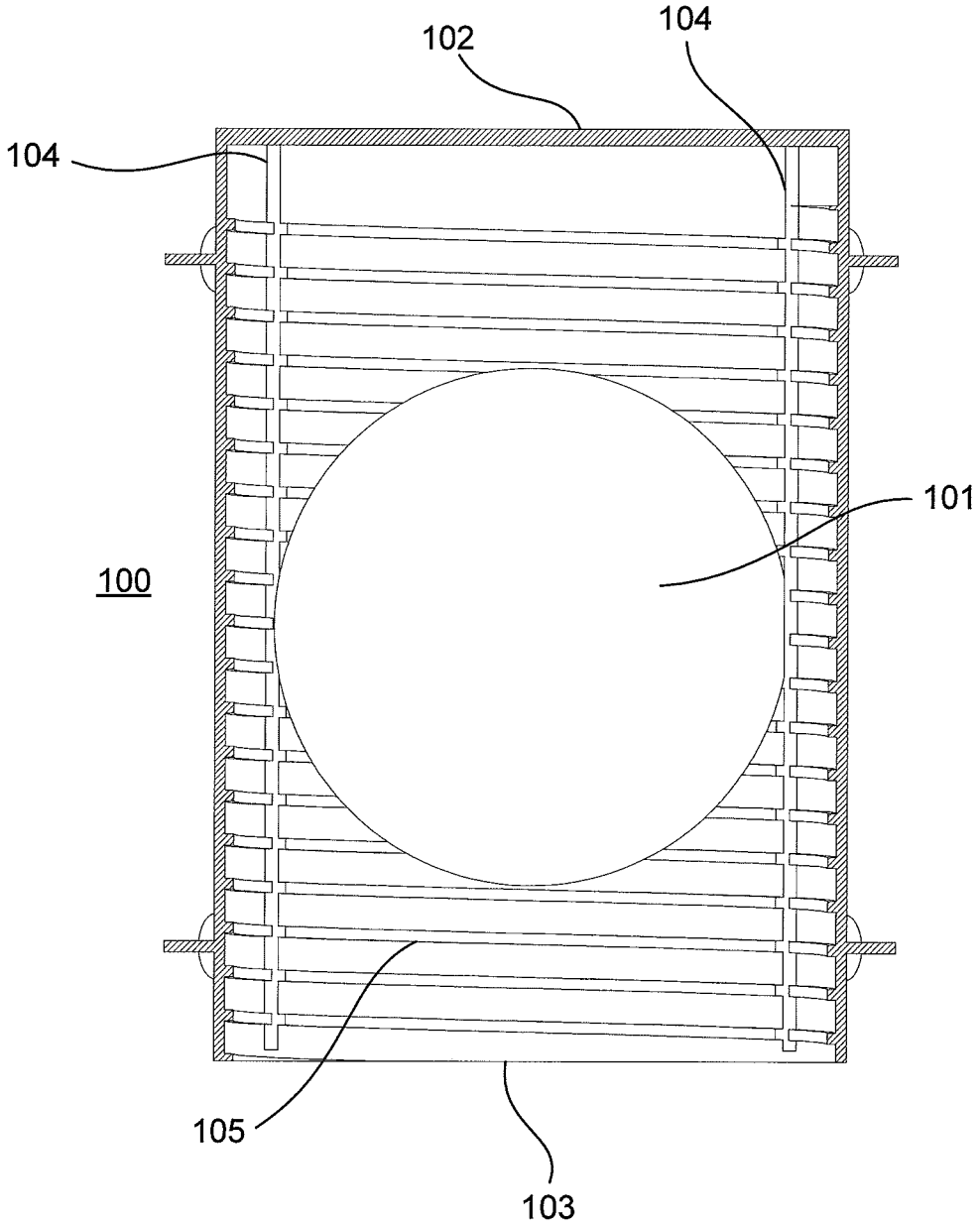
FIG. 4 shows a side view of a sectioned container accommodating the thruster assembly of FIG. 1.

FIG. 4 is a cross-sectional schematic view of the container 100 taken axially through the center of the container 100. The internal surface or wall of the container is provided with protruding threads 105 to engage with mating threads in a part of the drive assembly to be described below. Each of the numerous guiding means 104 are provided as elongate recesses in the container wall extending in a direction parallel with the longitudinal axis of the container 100. The guiding means 104 are arranged to accommodate corresponding guiding means of the drive assembly, such as lugs or similar, to be described in further detail below.

Figure 5:
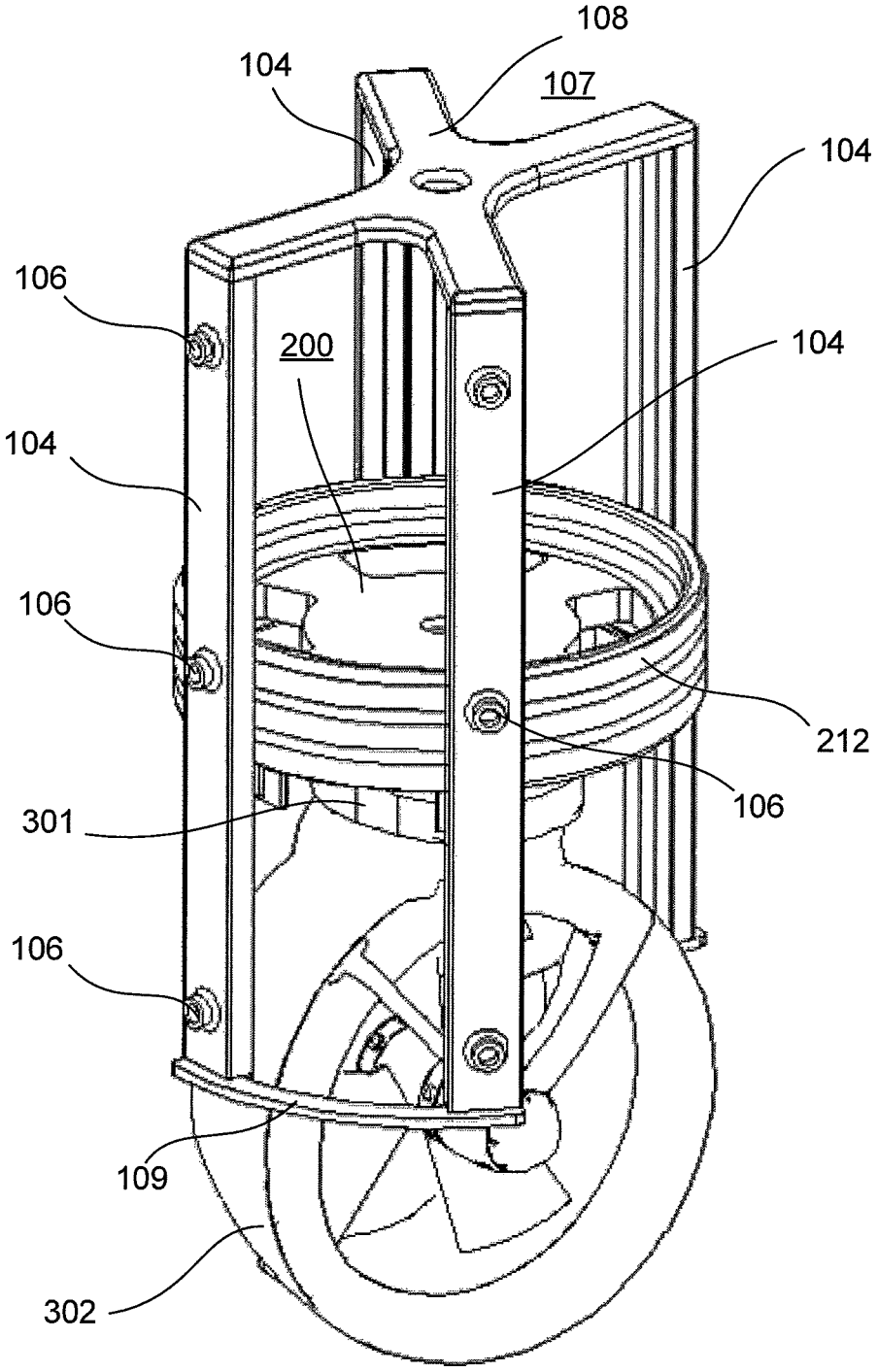
FIG. 5 illustrates an alternative embodiment of the thruster assembly viewed in perspective.

FIG. 5 illustrates, in a perspective view, a second embodiment of the thruster assembly. In the depicted embodiment the container 100 has been replaced by a frame assembly indicated generally at numeral reference 107. The frame assembly 107 comprises numerous elongate guiding means 104 extending parallel to the longitudinal axis of the elongate frame structure 107 and exhibiting an outer periphery defining an imaginary cylinder. The guiding means 104 of the second embodiment, as depicted in FIG. 5, are similar to the guiding means 104 of the first embodiment, as depicted in FIGS. 1-4 and described above, and are therefore denoted by the same numeral reference. The respective guiding means 104 are interconnected at their upper end by a horizontally extending connecting strut 108, also denoted as upper strut. The respective elongate guiding means 104 are provided with a recess shaped to accommodate lugs (not shown in this figure), of the drive assembly indicated generally by numeral reference 200, to allow the respective lugs to move within the respective opposing recess in a sliding manner. At least two pairs of adjacent guiding means are interconnected by one or more lower struts 109, such as an arch shaped bar or similar, at their lower end. In this manner, a rigid frame structure is obtained that is able to withstand torsional forces from an operating thruster being held, lowered, or elevated in the frame structure 107. However, this embodiment does not have any threads like the threads 105 of the first embodiment. Instead, the threads are replaced by rollers or sliders (not shown) attached to the guiding means 104 that engage with threads 212 of the drive assembly 200. Accordingly, when rotating the drive assembly 200, including the thruster 300 in one direction or the other, the assembly 200 will slide either up or down with its drive assembly guiding means 203, such as lugs, (depicted in FIGS. 6-8) along the guiding means 104. In this way the drive assembly 200 and the thruster 300 are held firmly to withstand torsion forces imposed by the operating thruster 300.

Figure 6:
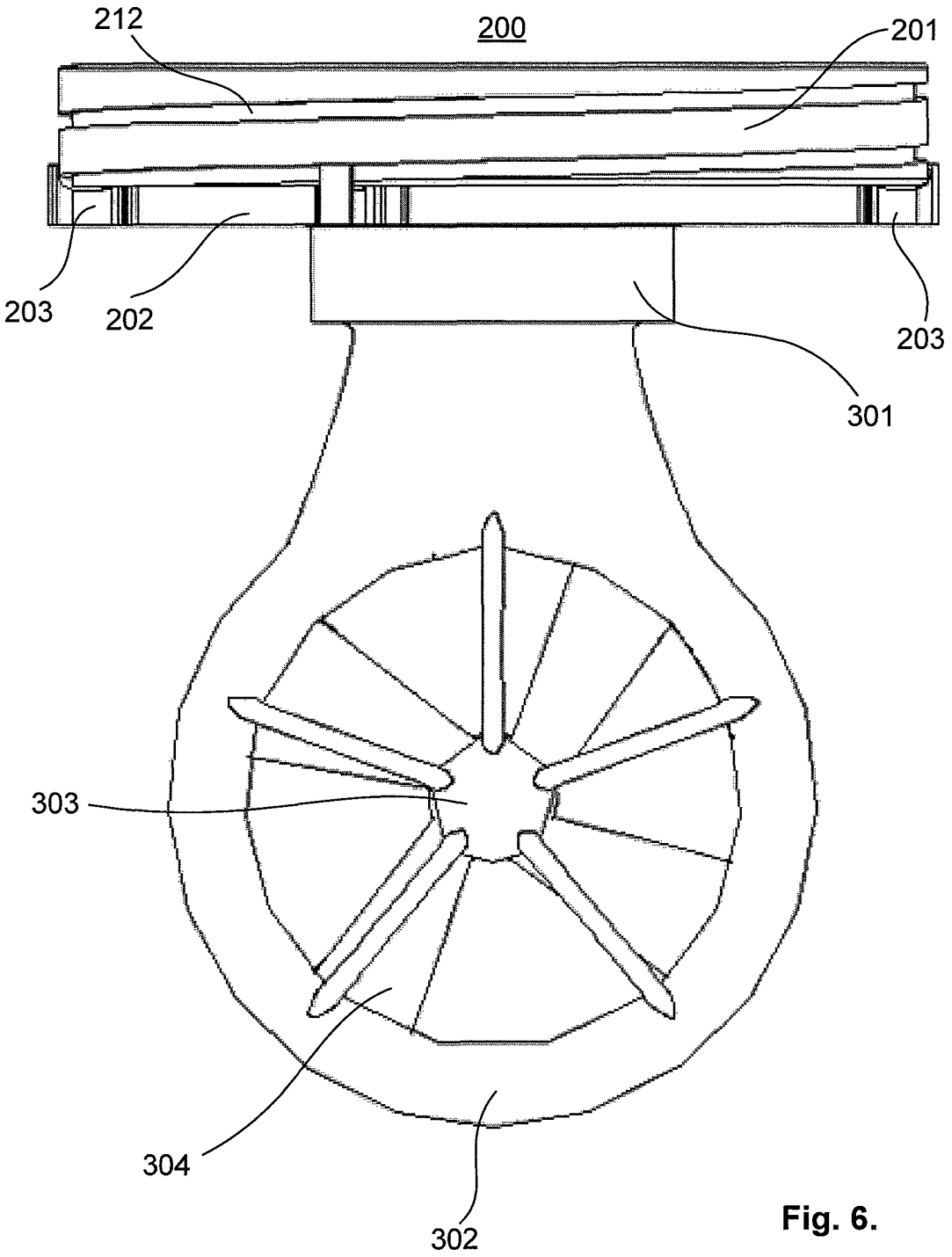
FIG. 6 is a side view of the drive assembly of FIG. 5 with a thruster suspended therefrom.

FIG. 6 is a side view of the drive assembly 200 in a compound arrangement including the thruster 300 itself being suspended from the drive assembly 200 via an attachment flange 301. In further detail, the drive assembly 200 comprises an upper housing 201 and a lower housing 202. The upper housing is, as mentioned above, provided with threads 212 to engage with corresponding threads 105 on the internal wall of the container 100, or with rollers or similar (not shown). The rollers may be arranged on the barrel-shaped container embodiment 100 illustrated in FIGS. 2-4 as well as with the frame structure embodiment illustrated in FIG. 5. The upper housing 201 is arranged rotary in the frame structure embodiment of FIG. 5 or inside the container embodiment of FIGS. 2-4. To the contrary the lower housing 202 is vertically movable within the container 100 or the frame structure in a non-rotary manner. The upper housing 201 exhibits a larger diameter than the lower housing 202. The drive assembly guiding means 203, illustrated in the form of lugs or similar, are attached to the periphery of the lower housing 202 protruding a certain distance beyond the outer periphery of the upper housing 201. The drive assembly guiding means 203, in the following also denoted as lugs, arranged along the periphery of the lower housing do naturally correspond to the position of the guiding means 104 of the container 100 or the frame structure 107.

Figure 7:
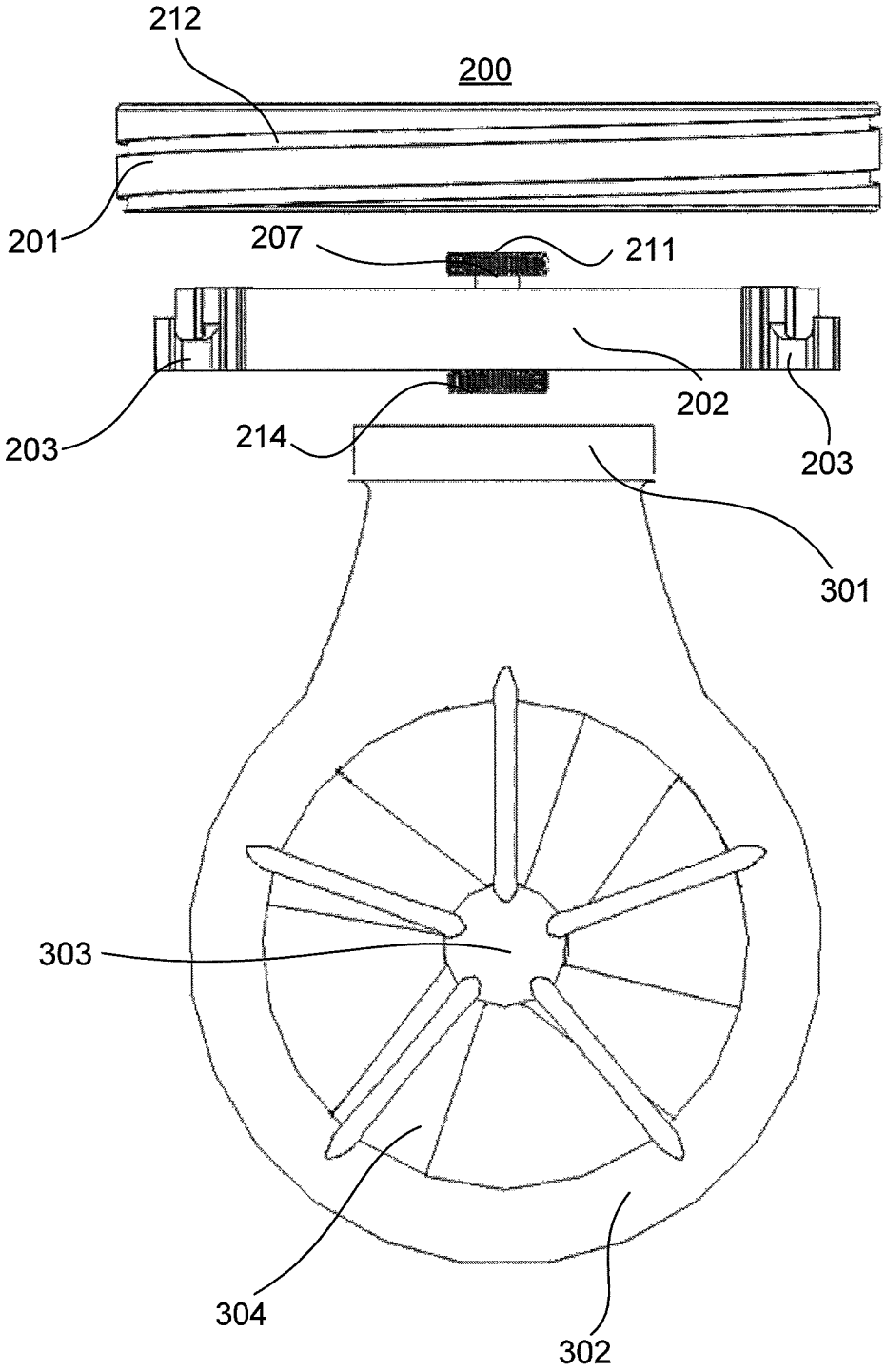
FIG. 7 is an alternate side view of the drive assembly of FIG. 5 where the drive assembly has been partly dismantled.

FIG. 7 is a side view similar to FIG. 6, but where the respective parts of the drive assembly 200 has been exploded to illustrate the upper housing 201 and the lower housing 202 including the thruster itself 300. Upper 201 and lower 202 housings are arranged to move independently from each other. A vertically extending shaft 207, also denoted as power shaft, is arranged in an aperture 208 (depicted in FIG. 8) in the lower housing. The shaft 207 is arranged in a driving connection with a motor that may put the shaft into rotation. Similar concentric apertures are provided in the remaining components of the lower housing as well (for example indicated by 210 in FIG. 8). Moreover, the shaft 207 is vertically movable between an upper position and a lower position. In further detail, the shaft 207 is at its upper end connected to a first gear device 211 and at its lower end connected to a second gear device 214, also denoted as a lower gear device. The flange 301 of the thruster 300 in one embodiment is provided with a similarly shaped recess (not depicted) in its upper surface to accommodate the lower gear device 214 of the shaft 207. In a similar manner, the lower surface of the upper housing 201 is provided with a recess (not depicted) exhibiting a shape corresponding to the first gear 211 to enable the shaft 207 with its gear device 211 to be accommodated in the recess of the upper housing 201. This construction is also denoted as upper and lower spline couplings, respectively, as described in further detail below.

A switching device, which is to be explained in further detail below, is arranged with the shaft 207 to move the shaft in an upwards direction to bring the first gear device 211 into engagement with the upper housing 201. Accordingly, when the shaft 207 with its gear device 211 is in engagement with the upper housing 201, there is no longer a connection between the shaft 207 and the thruster 300 (with reference to the second gear device 214), and rotational power from the shaft 207 supplied by the motor puts the upper housing 201 into rotation, in one direction or the other. Then, due to the threads 212 on the upper housing and the mating rollers or threads on the frame structure 107 or the container 100, the drive assembly including the suspended thruster 300 will rotate and slide downwards, or upwards, along the guiding means 104 accommodating the lugs 203. In this manner, the thruster 300 may be lowered down into the water to steer, and provide propulsion of, the vessel 11, or retracted into the frame structure 107 or into the container 100. However, it should be noted that the thruster 300 in an alternative manner may slide downwards and upwards without rotation, dependent on the arrangement of the planetary gears and switching mechanism. In a second operating mode, the switching device is able to move the shaft 207 downwards to bring its second gear device 214 into engagement with the mating recess in the upper surface of the flange 301 of the thruster 300. In this position, the shaft 207 and its upper spline coupling 211, 217, are released from engagement with the upper housing 201 and there is no driving connection therebetween (depicted in FIG. 10*b*). In a similar manner as described above, rotational power transferred from the motor to the shaft 207 will be transferred to the thruster 300 and make the thruster to rotate about the longitudinal axis of the container 100 or frame structure 107 to rotate the thruster into the desired position for steering and propulsion of the vessel in the water.

However, it should be noted that the example above illustrating one embodiment of establishing a driving connection between shaft 207 and thruster 300 may be implemented by numerous alternative connector devices, which should be within reach of a person skilled in the art having the present specification by hand.

The gear devices 211 and 214 including their corresponding recesses in the upper 201 and lower 202 housings may have any shape as long as they provide a firm engagement there between, such as toothed wheels. Guiding means (not depicted) are advantageously provided at the recesses or the gear devices 211 and 214 to simplify engagement with the respective recesses.

Figure 8:
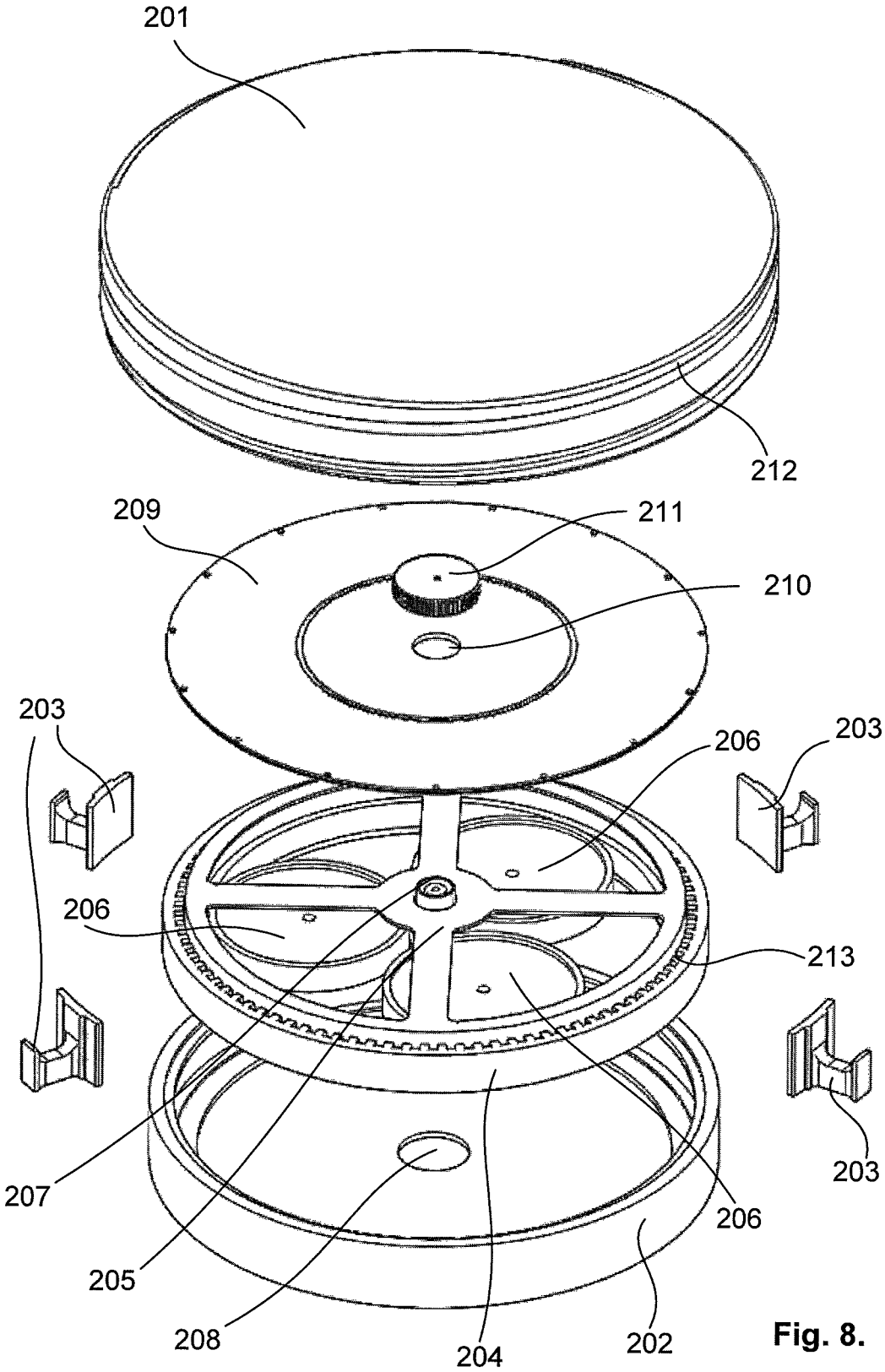
FIG. 8 is an exploded elevation view of the drive assembly of FIG. 7.

FIG. 8 is an exploded view in perspective of the drive assembly 200 of FIG. 7. The illustrated embodiment of the motor and drive assembly may be used with both the first and second embodiment of the thruster accommodating structure 100. Here, the motor device is implemented in the form of a permanent magnet motor. As will be seen and appreciated, the drive assembly 200 according to this embodiment provides a compact assembly without pipes or conduits subject to leakage or fracture. In further detail, the lower housing 202 exhibits a closed lower surface provided with a centrally arranged aperture 208 to accommodate the shaft 207 described above. A permanent motor assembly, described in further detail below, is covered by a lid 209 to cover the motor assembly accommodated within the lower housing 202. The motor assembly comprises, viewed in a direction towards the center of the lower housing 202, a permanent magnet stator 204 accommodated therein, a permanent magnet stator 213, and a permanent magnet rotor device 205 arranged rotary within the permanent magnet stator 213. The shaft 207 extends through an aperture formed in the permanent magnet rotor device 205. Three planetary gears 206 are arranged in a mutual rotary engagement and with the permanent magnet rotor device 205. The planetary gears 206 are surrounding the shaft 207 in a driving connection therewith. Whereas the example above suggests for example inclusion of three planetary gears 206, a person skilled in the art may provide alternative arrangements of the drive assembly. Therefore, the embodiment illustrated should be interpreted as a non-limiting example of an implementation of the retractable thruster.

Figure 9A:
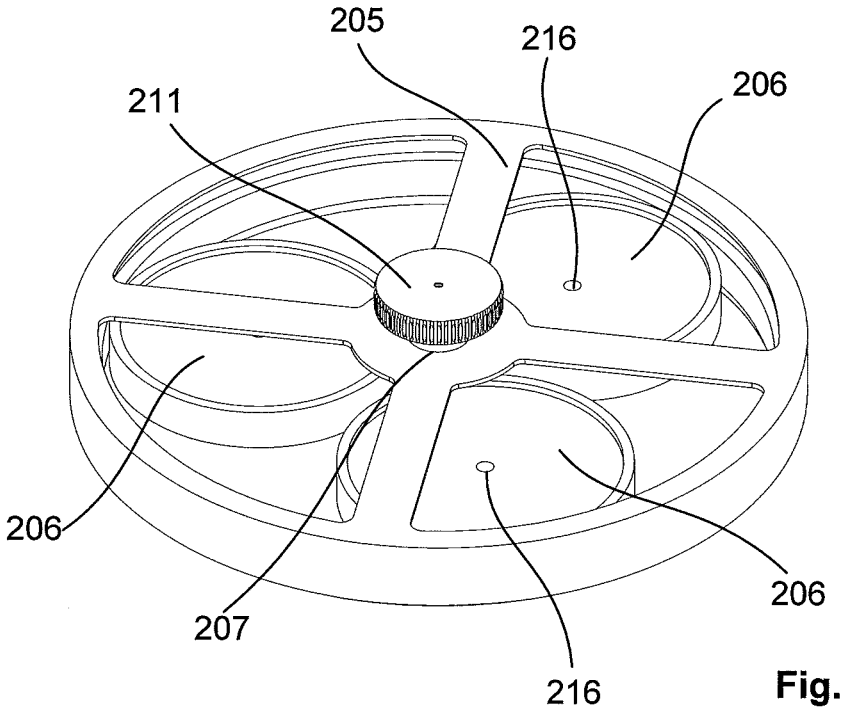
FIGS. 9*a* and 9*b* are schematic drawings illustrating an example of attachment of power transmitting planet gears.
Figure 9B:
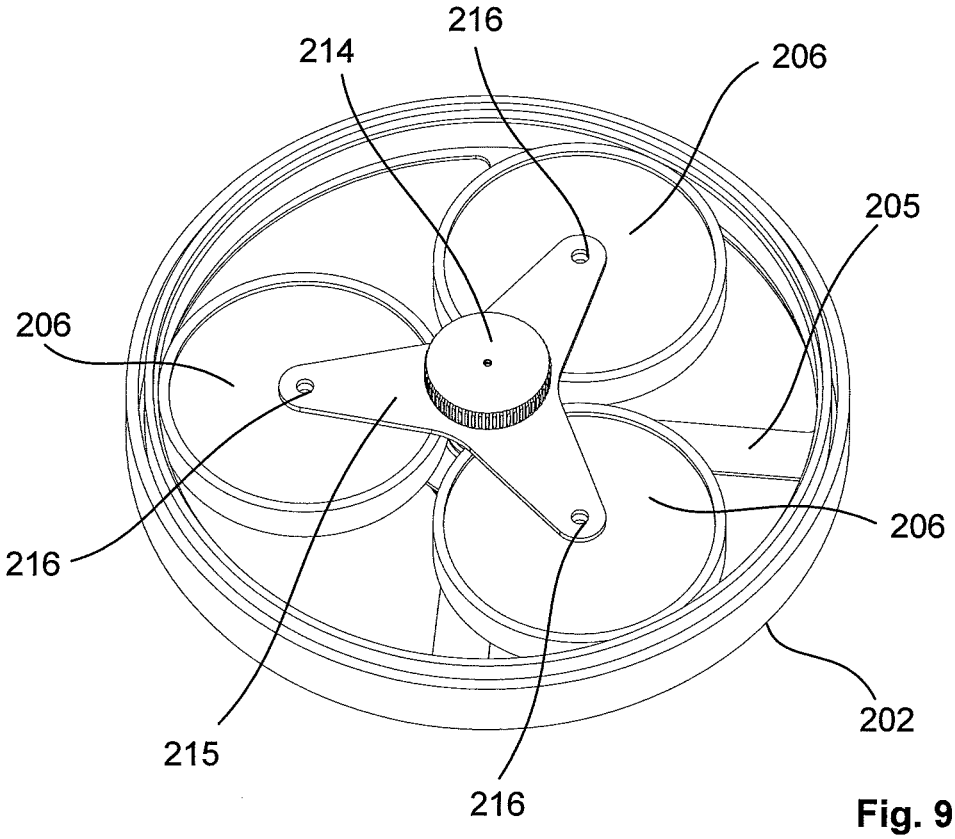

As can be seen from FIGS. 9*a* and 9*b*, the respective planetary gears 206 are attached in a rotary manner to the shaft 207 via an attachment plate 215 about pins 216 or similar, in a fixed engagement with the shaft 207. FIG. 9*a* shows the assembly from above, whereas FIG. 9*b* shows the assembly from below where the bottom part of the lower housing 202 has been cut away for simplicity to illustrate the engagement between the shaft 207 and the planetary gears 206. Accordingly, rotary movement created by the permanent magnet motor is transferred from the rotor device 205 and further to planetary gears 206 to transform the rotary movement to a lower speed but with a substantially higher momentum. The planetary gears 206, being in a fixed rotary engagement with the shaft 207, will transfer their rotary movement to the shaft 207 and bring the latter to rotate. On the other hand, the shaft 207 is attached vertically movable in relation to the attachment plate 215 but in a rotary fixed manner with the same. This may be realized in several manners, which will be known to a person skilled in the art, such as projections provided on the external surface of the shaft 207 movable into corresponding recesses in the attachment plate 215.

Figure 10A:
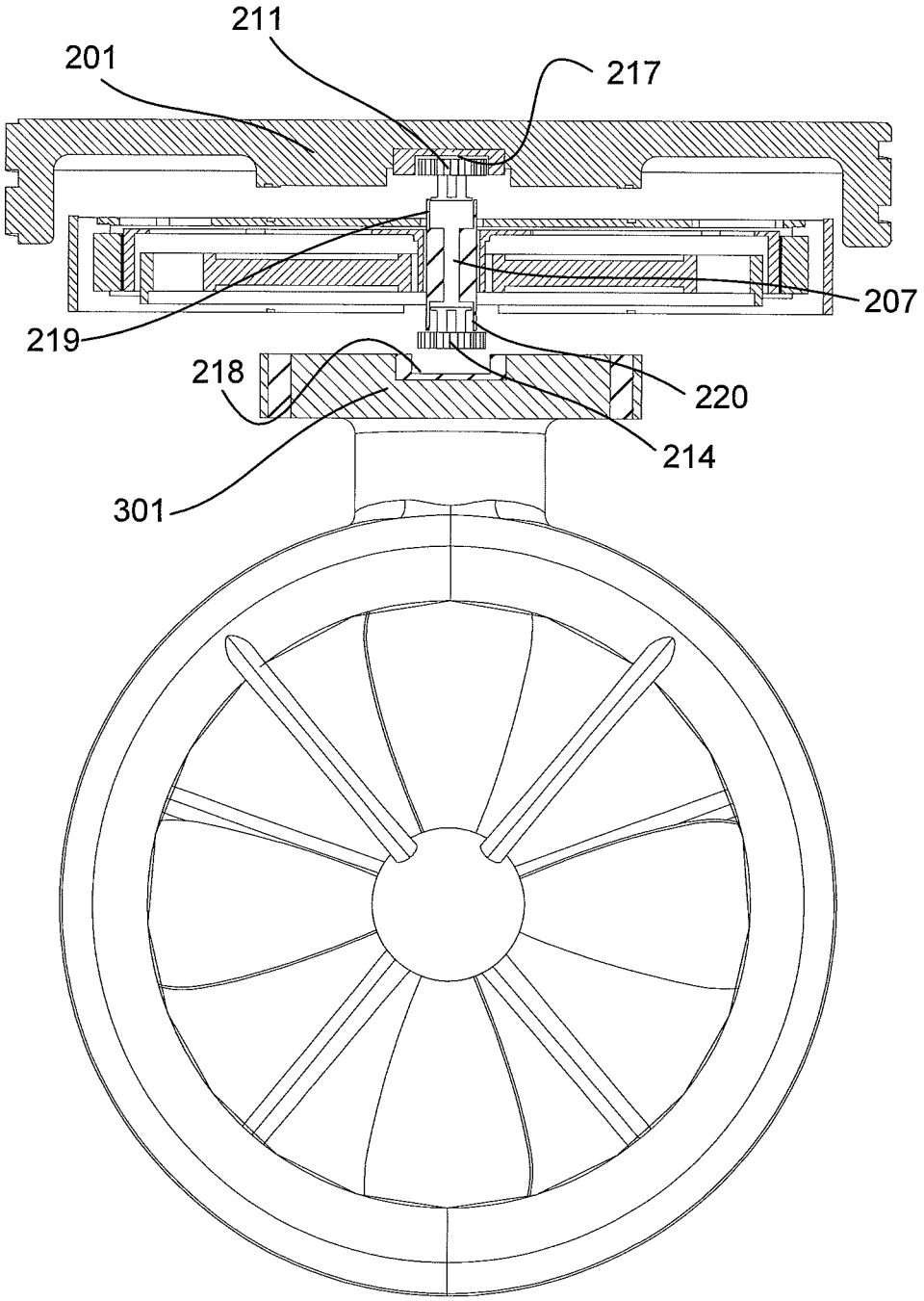
FIGS. 10*a* and 10*b* show a cross-section through the drive assembly exposing details of a switching device, where
Figure 10B:
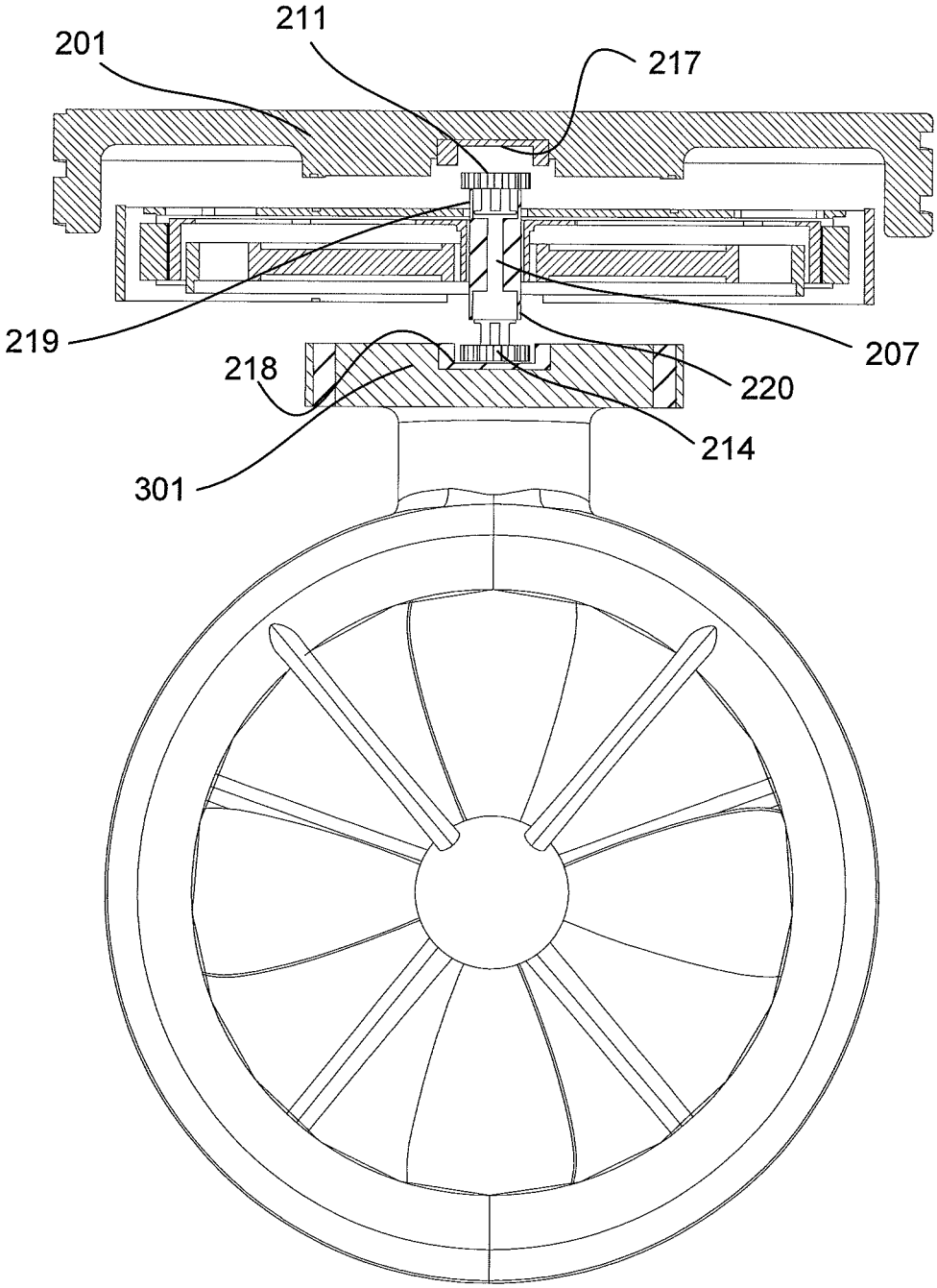

FIGS. 10*a* and 10*b* provide a schematic illustration of the switching mechanism that enables power to be transferred either to the thruster deploying and retracting device (or upper housing) 201 or to the flange 301 connected with the thruster 300. The figures are a schematic cross-section through a part of the drive assembly 200. The peripheral parts including numerous details have been omitted to simplify interpretation of the switching mechanism. Note that the shaft 207 is indicated in the drawings.

As can be seen from FIG. 10*a*, the shaft 207 comprises a gear device 211 attached to the upper end of the shaft 207 and is in this position in engagement with a corresponding recess 217 formed in the upper housing 201 in a rotary fixed manner. The gear device 211 and the recess 217 are together with the shaft 207 also denoted as an upper spline coupling 211, 217. An upper actuator 219, such as an electrical or hydraulic actuator, is arranged at the upper end of the shaft 207 to bring the upper spline coupling 211, 217 into engagement with the upper housing 201. Accordingly, FIG. 10*a* illustrates an operating mode where the power transferring shaft 207 is in engagement with the upper housing but out of engagement with the thruster flange 301. Power transferred from the motor assembly is solely transferred to the upper housing 201 to move the drive assembly 200 and the accompanying thruster 300 along the longitudinal axis of the thruster assembly and hence deploy the thruster 300 into the water or retract the same into the thruster accommodating structure 100.

Similarly, as can be seen from FIG. 10*b*, the shaft 207 comprises a gear device 214 attached to the lower end of the shaft 207 and is in this position in a rotary fixed engagement with a corresponding recess 218 formed in the thruster 300, particularly in the upper surface of the thruster attachment flange 301. The gear device 214 and the recess 218 are together with the shaft 207 also denoted as a lower spline coupling 214, 218. A lower actuator 220, such as an electrical or hydraulic actuator, is arranged at the lower end of the shaft 207 to bring the lower spline coupling 214, 218 into engagement with the thruster flange 301. Accordingly, FIG. 10*b* illustrates an operating mode where the power transferring shaft 207 is in engagement with the thruster 300 but out of engagement with the upper housing 201. Power transferred from the motor assembly is solely transferred to the thruster 300 to rotate the latter about the longitudinal axis of the thruster assembly and hence rotate the thruster in the desired direction in the water for steering and propulsion of the vessel.

It should be noted that this example of an embodiment of the drive assembly including its motor, gear mechanism, shaft with upper and lower spline couplings, and their actuators is just one out of many possible implementations that a person skilled in the art would be able to derive with support from the present specification. Accordingly, alternative switching mechanisms and motor assemblies, such as hydraulic motors are conceivable. Moreover, the gear mechanism implemented in the form of the planetary gears 206 should also only be considered as an example and not limiting the scope of this disclosure. Accordingly, numerous embodiments of the retractable thruster should be conceivable as long as the basic idea of the lowering, retracting and orientation of the thruster with one single drive mechanism in a particularly compact assembly compared to the prior art solutions, is preserved.

The invention claimed is:

1. An assembly for a retractable thruster (300) suitable for attachment to a hull of a maritime vessel (11), said assembly comprising: a thruster accommodating structure (100) from which the thruster (300) may be deployed and retracted from a body of liquid, said thruster accommodating structure (100) is provided with a drive assembly (200) and the thruster (300) is suspended by the drive assembly (200), said drive assembly (200) includes a thruster rotating device comprising a lower housing (202) accommodating a motor assembly and further exhibiting numerous drive assembly guides (203) arranged at a mutual distance along a periphery of the lower housing (202) to engage with elongate guides (104) arranged in the thruster accommodating structure (100), said elongate guides (104) extend parallel to a longitudinal axis of the thruster accommodating structure (100) in a sliding manner and include a thruster deploying and retracting device comprising an upper housing (201) having a periphery exhibiting threads (212) inside the periphery to engage with corresponding elongate guides (104) of the thruster accommodating structure (100) in a sliding manner to enable rotation of the upper housing (201) and displacement of the drive assembly (200) about the longitudinal axis of the thruster accommodating structure (100), the lower housing (202) also includes a switching device (211, 214, 217, 218, 219, 220) that allows power to be transferred either to the thruster deploying and retracting device to enable movement of the thruster (300) along the longitudinal axis of the thruster accommodating structure (100) or allows power to be transferred to the thruster (300) to enable rotation of the thruster (300) about the longitudinal axis of the thruster accommodating structure (100) to a desired direction and allow steering and propulsion of the vessel (11).

2. The assembly of claim 1, wherein the thruster accommodating structure (100) is substantially cylindrically shaped.

3. The assembly of claim 1, wherein the periphery of the upper housing (201) exhibits a larger diameter than the diameter of the outer periphery of the lower housing (202) and the drive assembly guides (203) comprises numerous lugs (203) attached at a mutual distance to the periphery of the lower housing (202) and projected a certain distance beyond the periphery of the upper housing (201).

4. The assembly of claim 1, wherein the motor assembly is a permanent magnet motor assembly.

5. The assembly of claim 1, characterized in that the switching device comprises a power shaft (207) provided with an upper spline coupling (211, 217) to enable a releasable engagement with the upper housing (201), and a lower spline coupling (214, 218) to enable a releasable engagement with the thruster (300), said power shaft (207) being arranged in a driving engagement with the motor assembly and movable between engagement with the upper housing (201) and the lower housing (202).

6. The assembly of claim 5, wherein the switching device comprises an upper actuator (219) and a lower actuator (220) arranged to bring the respective spline couplings (211, 217; 214, 218) in and out of engagement with the upper housing (201) and the thruster (300).

7. The assembly of claim 6, wherein the actuators (219, 220) are electrical actuators or hydraulic actuators.

8. The assembly of claim 1, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

9. The assembly of claim 2, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

10. The assembly of claim 3, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

11. The assembly of claim 4, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

12. The assembly of claim 5, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

13. The assembly of claim 6, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

14. The assembly of claim 7, wherein the thruster accommodating structure (100) further comprises a cylindrical, barrel-shaped container having a closed upper end (102) and an open lower end (103) and the elongate guides (104) exhibits threads (105) provided on the internal surface of the thruster accommodating structure (100) mating the threads (212) of the upper housing (201), whereby the elongate guides (104) of the thruster accommodating structure (100) are arranged to engage with the drive assembly guides (203) of the lower housing (202) in a sliding manner.

15. The assembly of claim 8, wherein the container (100) is provided with two opposing apertures (101) having a size and geometry corresponding to a nozzle (302) of the thruster (300).

16. The assembly of claim 1, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

17. The assembly of claim 3, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

18. The assembly of claim 4, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

19. The assembly of claim 5, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

20. The assembly of claim 6, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

21. The assembly of claim 7, wherein the thruster accommodating structure (100) is cylindrical and is provided in the form of a frame structure (107) exhibiting numerous elongate guides (104) interconnected at their upper end by a horizontally extending connecting upper strut (108) and interconnected at their lower end by one or more lower struts (109), said elongate guides (104) being arranged to accommodate corresponding drive assembly guides (203) of the lower housing (202) and of the drive assembly (200) to allow displacement of the drive assembly (200) and the suspended thruster (300) along a longitudinal axis of the frame structure (107), whereby the frame structure (107) further comprises rollers arranged to engage with the threads (212) of the upper housing (201) of the drive assembly (200) to enable rotation of the thruster (300) about the longitudinal axis of the frame structure (107).

* * * * *